United States Patent [19]

Fabian

[11] 4,060,858

[45] Dec. 6, 1977

[54] SELF-CENTERING TOILET VALVE

[76] Inventor: Emil L. Fabian, 553 W. 38th St., San Pedro, Calif. 90731

[21] Appl. No.: 651,066

[22] Filed: Jan. 21, 1976

[51] Int. Cl.[2] ..... E03D 1/34

[52] U.S. Cl. ..... 4/57 R; 4/52; 4/56

[58] Field of Search ..... 4/57 P, 67 R, 57 R, 4/52, 56, 65, 68; 137/533.21, 34, 37; 251/323; 267/166, 167, 169, 178

[56] References Cited

U.S. PATENT DOCUMENTS

| | | | |
|---|---|---|---|
| 1,353,804 | 9/1920 | Schossow | 4/67 R X |
| 2,175,973 | 10/1939 | Reed | 4/57 R |
| 2,450,609 | 10/1948 | Phelps | 251/323 X |
| 2,524,474 | 10/1950 | Randel | 251/323 X |
| 2,615,177 | 10/1952 | Schlichting | 251/323 X |
| 2,638,108 | 5/1953 | Williams et al. | 251/323 X |
| 2,692,393 | 10/1954 | Souppee | 4/57 R |
| 2,834,374 | 5/1958 | Klinkenberg | 267/169 X |
| 3,478,368 | 11/1969 | Brewington | 4/57 R |

*Primary Examiner*—Henry K. Artis
*Attorney, Agent, or Firm*—I. Michael Bak-Boychuk

[57] ABSTRACT

A replacement valve for the holding tank of a toilet which includes a conical elastic valve element attached to a buoyant disc on the upper surface thereof. This valve assembly is then mounted on a centrally received shaft which extends downwardly from the lower surface of the valve to be received in the interior of a coiled spring centering guide. The centering guide, at the lower end thereof, includes four flexible convolved wire fingers which are compressed for receipt within the valve seat assembly.

7 Claims, 5 Drawing Figures

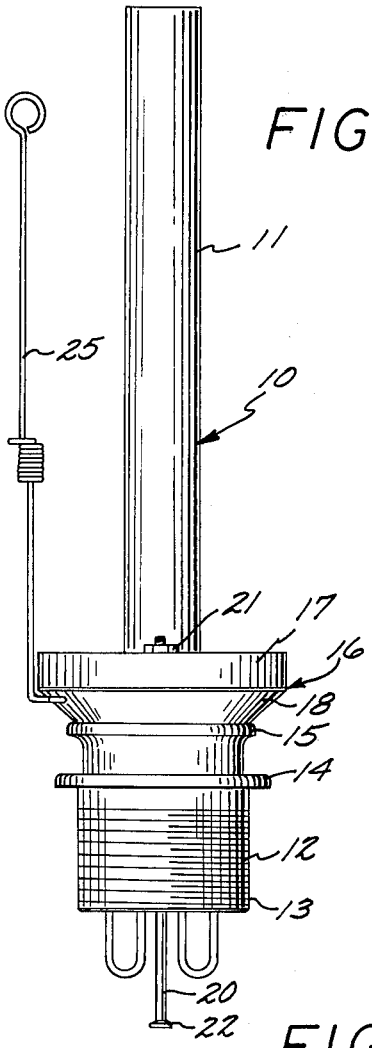
FIG. 1
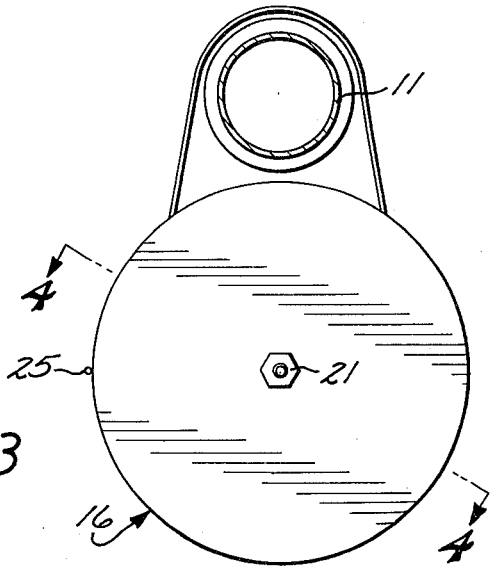
FIG. 3
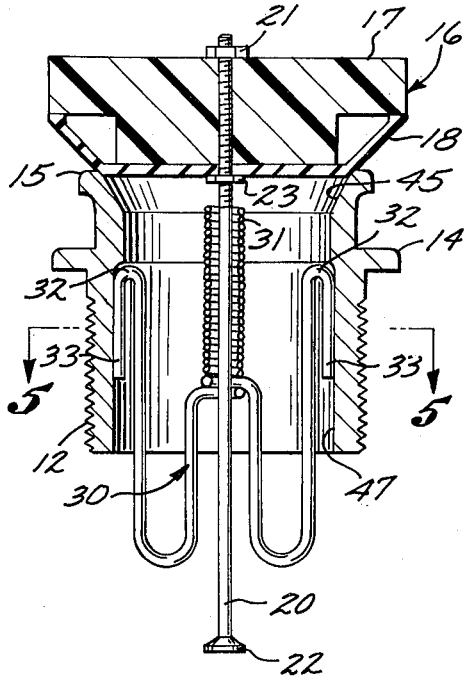
FIG. 4
FIG. 2
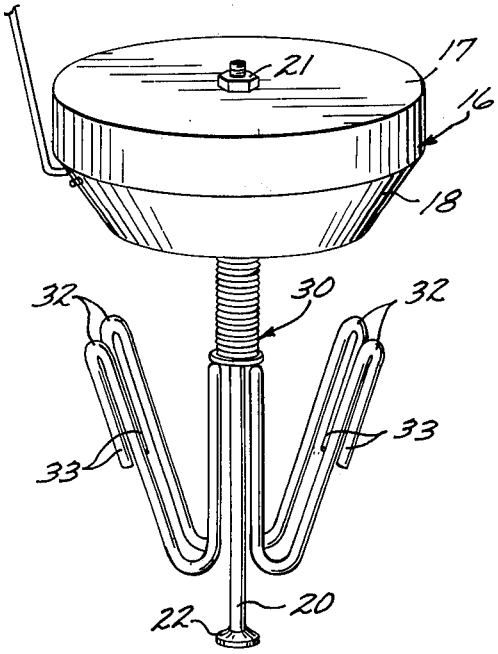
FIG. 5
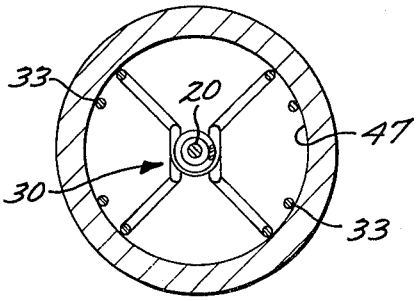

SELF-CENTERING TOILET VALVE

BACKGROUND OF THE INVENTION

1. Field of the Invention

The present invention relates to flush tank valve assemblies and more particularly to a replacement valve assembly useful with conventional toilet valve seats.

2. Description of the Prior Art

Hydrostatically closed toilet flush valves have been know in the past. Generally, the sealing interface of such a flush valve with the valve seat normally present in the bottom of the toilet holding tank a source of many problems to the home user. Accordingly, one of the repairs most frequently engaged by a home user is the replacement of such a valve. Generally, such a replacement is called for as a result of the deterioration of the valve body itself and quite often a concurrent corrosive deterioration of the seat. To provide for a convenient repair technique which accommodates both the deterioration of the valve and the valve seat, there have been replacement valves developed in the past which include conically projecting peripheral lips conformed to the conical shape of the seat. Such conically projecting peripheral valve lips distribute the sealing contact over a wide area of the seat and therefore avoids the necessity of resurfacing the seat in order to effect the seal. Use of such conically shaped replacement valves, however, generally always require some means for centering the valve relative the valve seat. When installed by the average home user high accuracy centering techniques are not always possible and, in fact, not desired in a replacement item. To achieve the centering techniques are not always possible, and, in fact, not desired in a replacement item. To achieve the centering function most valve assemblies include a guide which is mounted on the stand pipe or the overflow pipe in the holding tank and through which a shaft is passed which is then connected to the valve. The alignment of this guide is therefore a necessary step in installing the typical prior art replacement valves. Typically, however, both the seat and the stand pipe are formed as one integral structure and if corrosion or deterioration occurs in one part there is usually associated corrosion around the guide mounting making any adjustments therein quite difficult and often leading to the breakage of the standpipe at the connection thereof. A further problem with this prior art arrangement of parts is the rotary articulation of the thrushing lever which does not easily adapted to the vertical up and down motion necessary in the guide. This rotary articulation of the lever therefore produces additional lateral dislocation of the valve during its seating sequence rendering such a replacement valve less effective. To reduce this last mentioned problem there have been several valve seats developed in the past wherein the guide is disposed below the seating plane and a guide rod is provided extending from the lower surface of the valve. Such assemblies, however, have not gained wide acceptance in this field and most valve seats still in use do not include the desired lower guide.

SUMMARY OF THE INVENTION

Accordingly, it is the general purpose and object of the present invention to provide a replacement valve assembly which includes, as one of its parts, a spring loaded guide insertable into the valve seat.

Other objects of the invention are to provide a self-guiding replacement valve which is adapted to accommodate various sized valve seat assemblies.

Yet further objects of the invention are to provide a replacement valve assembly which is convenient in use, simple to install and does not require closed installation tolerances.

These and other objects are accomplished within the present invention by providing a frustoconical flexible valve seal which is disposed on the lower surface of a buoyant disc to be hydrostatically pressed against the valve seat. Extending through the disc and the conical seal is a centering guide rod arranged in concentric alignment therewith to project downwardly into the interior of the seat. Disposed around the guide is a tightly coiled spring assembly which functions as a centering guide, the lower end of the spring assembly terminating in a plurality of bent fingers which, in their normal prestress, extend beyond the interior dimensions of the seat. During installation, the fingers are compressed inwardly to be received within the seat and are forced downwardly into the seat to thus provide a centering arrangement. Once so arranged, the centering rods can then be articulated through the interior of the coil spring guide and any release of the hydrostatic pressure differential across the valve would render such valve buoyant, releasing the water from the holding tank. By virture of this arrangement of parts, the use of an upper guide normally mounted from the stand pipe is not necessary and any means can be utilized to achieve the opening articulation of the valve.

BRIEF DESCRIPTION OF THE DRAWING

FIG. 1 is a front view illustrating a prior art valve seat assembly incorporating the inventive replacement valve;

FIG. 2 is a perspective illustration illustrating the features of the inventive replacement valve prior to the insertion thereof into the valve seat assembly;

FIG. 3 is a top view of the assembly shown in FIG. 1;

FIG. 4 is a sectional view taken along line 4—4 of FIG. 3; and

FIG. 5 is yet another sectional view taken along line 5—5 of FIG. 4.

DESCRIPTION OF THE SPECIFIC EMBODIMENT

While the following description is directed primarily at the structure of an inventive toilet flush valve, such is for purposes of illustration only. It is to be understood that those skilled in the art may find uses other than those expressly set forth and no intent is therefore expressed by the choice of illustrations herein.

As shown in FIG. 1 a conventional valve seat assembly, generally designated by the numeral 10, comprises a stand or overflow pipe 11 extending upwardly from a valve seat through fitting 12. It is usually this through fitting 12 that is insertable into the bottom of the holding tank in a toilet (not shown) to provide the conduit for the water collected into the holding tank into the toilet. Typically, the through fitting 12 comprises a threaded section 13 extending downwardly from a sealing lip 14 which, on the upper surface thereof, forms a valve seat 15. Received within the seat 15 is a conical seal assembly 16 comprising a buoyant disc 17 having attached, on the lower surface thereof, a frusto-conical seal 18. A centering shaft 20 extends through the seal 18 and disc 17 to be engaged by a nut 21 on the upper surface thereof. At the lower end, the centering shaft 20 terminates in an enlarged radius cap 22 which is useful with the centering fixture described in more detail hereinbelow. This seal assembly is normally maintained against the seat 15 by the hydrostatic pressure in the holding tank and only when the sealing interface thereof is broken will the seal float upwardly from the seat. To achieve this disruption of the hydrostatic sealing engagement, an articulating lever assembly 25 is extended from one peripheral edge of the seal 18 to the flushing lever of the holding tank (not shown).

As shown in more detail in FIGS. 2, 3 and 4, the seal assembly 16 is aligned by the shaft 20 to a coencentric position relative a centering yoke 30. More specifically, yoke 30 comprises a closely wound helical spring 31 having an interior opening just slightly smaller than the radial dimensions of cap 22. Extending from the lower end of the helical spring 31 are four bent up fingers 32 comprising sections of a wire which depart generally downwardly from the bottom end of spring 31 and are bent upwardly from its lowest point along a conical surface. Each finger 32 furthermore includes a bent over end 33 to further distribute the contents thereof with respect to the interior cavity in the valve seat assembly 12. It is to be noted that in its expanded or free form, the general arrangement of fingers 32 is such that the ends thereof define a circle slightly greater than the interior radial dimension of the feed-through fitting 12. By manually grafting these free ends and deflecting such to a smaller dimension, the centering yoke is thus insertable through the valve seat 15 into the interior of the fitting. Once in position, as shown in FIG. 4, the yoke 30 will maintain its vertical orientation by virtue of the casting deformation within the fitting thus centering the guide shaft 20 and concurrently centering the valve assembly 16 during its downward articulation at the completion of a flushing cycle.

By particular reference to FIG. 4 the engagement of shaft 20 to the seal assembly 16 is made by way of a circular shoulder 23 disposed around the shaft 20, shoulder 23 abutting from the underside, the flexible seal 18. Nut 21, by its threaded engagement, then compresses the shoulder 23 against the seal to thus preclude any leakage thereacross. In this manner, a coencentric relationship of shaft 20 relative the seal assembly 16 is achieved, with the shaft 20 being furthermore centered by the coiled spring guide 31 within the central cavity of the through fitting 12. More specifically, as is conventionally practiced in the art, the seat 15 includes a conical seating surface 45 which, at its lower and reduced diameter end, communicates with a circular passage 46. Passage 46 then, in turn, expands into a larger cavity 47 within which the bent up fingers 32 are received. In this arrangement upward articulation of the yoke 30 is restricted by the shouldered interface between passage 46 and cavity 47. Concurrently, the height of the coiled spring guide 31 is controlled to project from this engagement point to a height substantially coincident with the bottom edge of the conical surface 45. Thus, variations in seat diameter or aging of the seal 18, will not result in interference.

An additional feature of the structure illustrated herein and particularly the sturcture of the centering yoke 30 is the flexibility of the upper end of the coiled guide 31. Accordingly, as the valve assembly 16 is withdrawn to various heights and is displaced from center during such a withdrawal, there will be a centering spring bias within the guide during its downward articulation.

As shown in FIG. 5, the disposition of fingers 32 and their bent over ends 33 achieves a widely distributed contact area within the cavity 47 thus utilizing the irregularities normally present as a result of casting on the surface of cavity 47 to best advantage. Finger 32 may either be attached or welded on the lower end of the coiled guide 31 or may actually extend upwardly forming the coil structure itself. Thus a convenient mode of manufacture is also provided where only minimal tooling is necessary to provide the required coil and bending configurations to the yoke. The float disc itself (i.e., the disc 17) is similarly convenient in manufacture, such disc being conveniently made out of any close set plastic foam.

Obviously many modifications and variations to the above disclosure can be made without departing from the spirit of the invention. It is therefore intended that the scope of the invention be determined solely dependent on the claims hereto.

I claim:

1. A replacement valve assembly adapted for insertion into the seat of a flush outlet of a toilet holding tank, comprising:

a frusto-conical flexible valve seal conformed for receipt in said valve seat;

a buoyant disc attached to the upper surface of said valve seat;

a centering shaft concentrically attached to said disc and said seal to extend axially therefrom in a direction away from the lower surface of said seal; and a centering yoke assembly supporting in contilener a coiled spring guide adaped to telescopically receive said centering shaft, a plurality of flexible fingers extending from the lower end of said guide, the free ends of said fingers extending beyond the dimensions of said outlet whereby an insertion of said fingers into said outlet maintains fingers in position.

2. Apparatus according to claim 1 wherein:

said centering shaft is dimensioned to a length substantially greater than said guide and includes an enlarged cap formed on the free end thereof having dimensions greater than the interior dimensions of said guide.

3. Apparatus according to claim 2 further comprising:

an articulable lever connected to said seal means for providing vertical articulation thereof.

4. A centering guide adapted for insertion into a valve seat for aligning the centering shaft of a valve during articulation, comprising:

a plurality of flexible wire elements coiled to form an interleaved helical coil over the first sections thereof and extending along radial planes from said guide in the form of bent over fingers over the second sections thereof, the free ends of said fingers being separated by a dimension greater than the interior dimension of said valve seat.

5. Apparatus according to claim 4 wherein:

said wire elements are bonded together at the juncture of said fingers and said guide.

6. Apparatus according to claim 5 wherein:

said seat includes a downwardly directed tapered surface; and said valve includes a frusto-conical elastic segment adapted to mate with said seat.

7. Apparatus according to claim 6 wherein:

said centering shaft is disposed axially from said valve for receipt in said guide.

* * * * *